US006382440B1

(12) United States Patent
Brant et al.

(10) Patent No.: US 6,382,440 B1
(45) Date of Patent: May 7, 2002

(54) CLOSURE HAVING RAISED SIDEWALL DISPLAY ELEMENTS

(75) Inventors: Jeffrey E. Brant; Richard Laveault, both of Crawfordsville; Thomas P. Hennessy, Indianapolis; Chon Tsai, Brownsburg, all of IN (US)

(73) Assignee: Alcoa Closure Systems International, Crawfordsville, IN (US)

( * ) Notice: Subject to any disclaimer, the term of this patent is extended or adjusted under 35 U.S.C. 154(b) by 0 days.

(21) Appl. No.: 09/522,549

(22) Filed: Mar. 10, 2000

(51) Int. Cl.[7] ..... B65D 39/00

(52) U.S. Cl. ..... 215/230; 215/329; 206/459.1; 53/490; 53/317

(58) Field of Search ..... 220/288; 215/230, 215/329, 365, 367; 206/459.1; 53/490, 317, 331.5; 40/307, 311; 434/113, 114

(56) References Cited

U.S. PATENT DOCUMENTS

| | | | | |
|---|---|---|---|---|
| 1,490,341 | A | * | 4/1924 | Olney |
| D90,246 | S | * | 7/1933 | Hall |
| D126,977 | S | * | 5/1941 | Gehm |
| D153,950 | S | * | 5/1949 | Jung |
| D153,951 | S | * | 5/1949 | Jung |
| D157,262 | S | * | 2/1950 | Jung |
| 3,413,743 | A | * | 12/1968 | Goodhue |
| 3,906,706 | A | * | 9/1975 | Conti |
| 3,984,965 | A | * | 10/1976 | Sonnenberg |
| 4,157,144 | A | | 6/1979 | Weiler et al. |
| 4,241,841 | A | | 12/1980 | Boller |
| 4,278,180 | A | | 7/1981 | Willis |
| 4,291,813 | A | | 9/1981 | Allen et al. |
| 4,497,765 | A | | 2/1985 | Wilde et al. |
| 4,588,465 | A | | 5/1986 | Paciorek |
| 4,618,121 | A | | 10/1986 | Conti |
| 4,633,646 | A | | 1/1987 | Ellis et al. |
| 4,727,998 | A | * | 3/1988 | Simon |
| 4,905,447 | A | * | 3/1990 | Margaria |
| 4,928,837 | A | | 5/1990 | Curiel |
| 4,984,703 | A | | 1/1991 | Burzynski |
| 5,011,032 | A | * | 4/1991 | Rollman |
| 5,157,897 | A | | 10/1992 | McKee et al. |
| 5,381,913 | A | | 1/1995 | Peeters |
| 5,753,350 | A | * | 5/1998 | Bright |
| 5,839,581 | A | | 11/1998 | Vagedes |
| H1777 | H | * | 2/1999 | Colby |
| 5,938,055 | A | * | 8/1999 | Phillips et al. |
| D438,800 | S | * | 3/2001 | Brant et al. |

FOREIGN PATENT DOCUMENTS

| | | |
|---|---|---|
| DE | 2311279 | 11/1973 |
| FR | 2 687 377 A1 | 2/1992 |
| WO | WO 91/00227 | 1/1991 |

* cited by examiner

*Primary Examiner*—Nathan J. Newhouse
(74) *Attorney, Agent, or Firm*—Rocky Milnamow & Katz Ltd.; Edward L. Levine

(57) ABSTRACT

A closure includes a plurality of decorative display elements arranged at regular intervals around an outside surface of the closure, the decorative display elements, and gaps between the display elements, serving as engagement locations for a chuck to rotate the closure. According to one aspect of the invention, the display elements are peaked upwardly from an open bottom end of the closure, having wider base ends than distal ends, and the gap formed between the elements is tapered in a downward direction. In one embodiment, the display elements are stepped in profile having different levels of raised planes providing a three dimensional decorative display. The regularly spaced decorative elements also provide an enhanced gripping surface for the fingers of a consumer.

15 Claims, 4 Drawing Sheets

CLOSURE HAVING RAISED SIDEWALL DISPLAY ELEMENTS

TECHNICAL FIELD OF THE INVENTION

The present invention relates to closures for containers. Particularly, the invention relates to bottle closures having decorative features, and bottle closures having contoured gripping surfaces.

BACKGROUND OF THE INVENTION

Prior known closures for bottles include knurling on an outside surface thereof for enhancing gripping by a user. This knurling is usually in the form of axially oriented ribs. Such knurling is illustrated, for example, in U.S. Pat. No. 4,196,818 and 4,398,645.

Closures can be formed by compression molding or injection molding. The closure is typically formed on a core pin. Particularly, prior known closures are formed on a core pin having an outside contoured surface to form threads on an inside surface of the closure. After the closure has solidified, the closure inside threads are engaged with the core pin outside threads. The closure is removed from the core pin by either stripping or unscrewing. In the case of closures which are unscrewed from the core pin, the closure is gripped by a removal chuck and turned. The removal chuck includes metallic gripping elements for turning the closure. Turning of the closure by the removal chuck with respect to the core pin unscrews and separates the closure from the core pin for eventual shipping to a bottler.

During bottling, after a bottle is filled, an application chuck can be used to grip a closure and screw the closure onto the bottle. The application chuck is part of a capping machine, such as described in U.S. Pat. No. 4,633,646 and 5,157,897, herein incorporated by reference.

When a closure is to be turned by a chuck, the chuck typically includes an elastomeric element between the closure and the metallic gripping elements of the application chuck, to prevent the chuck from scratching or damaging the closure.

Prior known closures have included raised, molded graphics on the closure end wall, but not on the sidewall. This is due in part to the necessity of providing raised knurling on the sidewall and the necessity of providing a surface contour engageable by the application chuck.

The present inventors have recognized that it would be desirable to provide a closure having a decorative appearance on a sidewall thereof, and which could be effectively and economically manipulated by a closure chuck, and by a consumer.

SUMMARY OF THE INVENTION

The invention contemplates a closure for a container, the closure having a molded, raised decorative display on a sidewall thereof. The display includes spaced apart decorative elements forming gaps or spaces between the elements. A chuck can engage the closure and turn the closure by exerting tangential force on one or more of the display elements from a position within one or more of the gaps.

The raised decorative display includes a stepped radial extent or thickness along a radial direction. The display can also be stepped in the axial direction, preferably in decreasing radial extent, taken in an axial direction away from the open end of the closure toward the closed end of the closure. This allows for easy molding of the closure, and mold half removal, along an axial direction, from the formed closure.

Alternatively, the stepped radial extent could be stepped in the axial direction in an increasing radial extent, taken in an axial direction away from the open end of the closure toward the closed end of the closure. In this case, a molding apparatus having a laterally expanded female mold half can be used such as described in U.S. Ser. No. 09/523,083, filed on the same day as the present application. The female mold half opens laterally to be removed axially, so as not to damage the raised, molded graphic. This application is incorporated herein by reference.

The display elements are preferably peaked elements formed by diverging sides, the diverging sides forming the gaps between display elements. The display elements can be entirely separated by the gaps between adjacent display elements, or can have base end regions connected in contiguous relationship, i.e., blended together. The display elements can be regularly spaced around the circumference of the closure to assist in machine operation, i.e., any misalignment of the closure and an applications chuck can be easily corrected.

According to the invention, the conventional knurling of prior closures can be replaced with more decorative features or displays. The decorative display elements form a contoured surface that can be easily gripped by a consumer to forcibly turn the closure. The display elements being regularly spaced, can also serve a functional purpose, to be engageable tangentially by a machine controlled chuck, to rotate the closure.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 2:
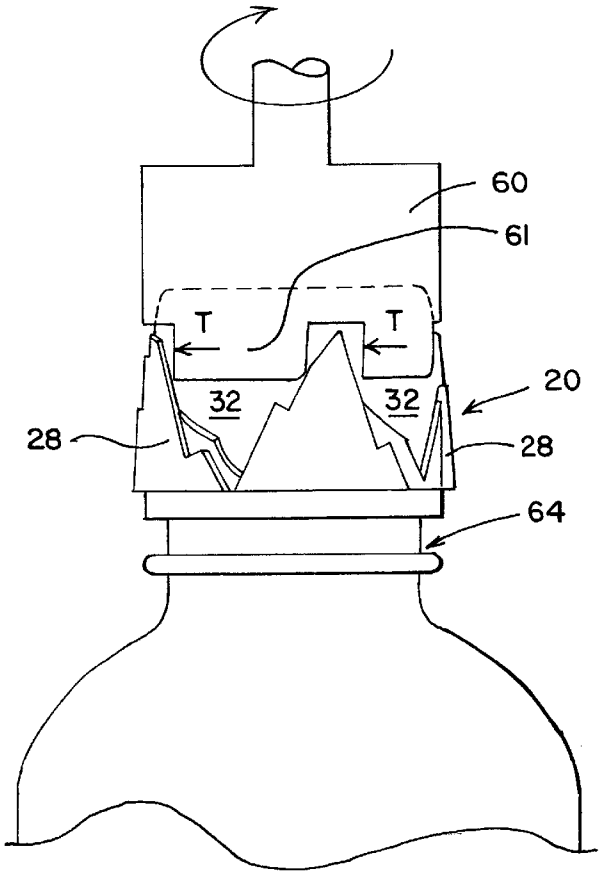
FIG. 2 is a diagrammatic elevational view of the first embodiment closure of FIG. 1 being applied to a bottle.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 1:
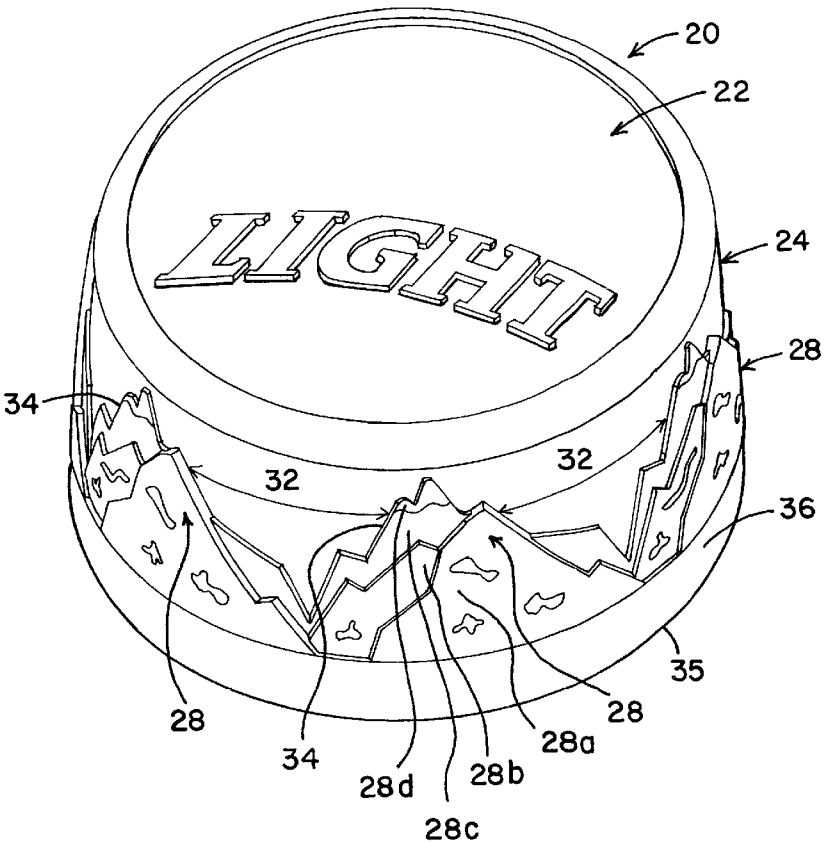
FIG. 1 is a perspective view of a first embodiment closure of the present invention.

FIG. 1 illustrates a closure 20 according to the present invention. The closure 20 includes an end wall 22 and an annular sidewall 24 depending therefrom. The sidewall includes a substantially smooth upper region 26 and raised display elements 28 arranged evenly spaced apart around a circumference of the sidewall 24. The display elements 28 are substantially peaked shapes, separated by gaps 32. The peaked shapes are defined by angularly disposed walls 34. The display elements 28 are contiguously connected around a circumference of the closure at a base end region of the closure near an open end 35 of the closure 20. A tamper evident band 36, as described more completely in U.S. Pat. Nos. 4,497,765 or 5,800,764, herein incorporated by reference, is disposed at the open end of the closure 20.

The display elements 28 are stepped in radial extent or radial thickness, along an axial direction. The elements 28 include, for example, a first radial plateau 28*a,* a second radial plateau 28*b,* a third radial plateau 28*c,* and a fourth radial plateau 28*d* in order of decreasing radial extent. The stepped profile of the display elements are such as to have a decreasing radial extent taken along a first axial direction from the open end of the closure toward the end wall 22. This facilitates removing, in the first axial direction a female mold half used to mold the closure.

The display element 28 is contoured to form a realistic depiction of a mountain.

Other depictions, decorations and designs are encompassed by the invention, including the examples set forth below.

FIG. 2 illustrates an application chuck 60 gripping the closure 20 during rotation and screwing onto a bottle 64. The application chuck 60 grips an outside surface of the closure and tangentially presses against the display elements 28 with a force T and turns the closure, screwing the closure onto the bottle 64, particularly onto a bottle finish of the bottle. The application chuck 60 includes finger elements 61 that each fit within one gap 32 and can press tangentially against one of the walls 34 of the display element 28. Because of the angled walls 34 of the display elements 28, the chuck finger elements 61 can be guided axially into the gaps 32, given small rotational misalignment between the chuck finger elements 61 and the display elements 28.

Although an application chuck is illustrated in FIG. 2, the closure of the invention is also adapted to be engaged by a removal chuck for unscrewing the closure from a core pin, for example. In that circumstance, the finger elements would exert a tangential force that is opposite to the force indicated in FIG. 2, to opposite facing walls 34 of the closure, to turn the closure in an opposite direction.

Figure 3:
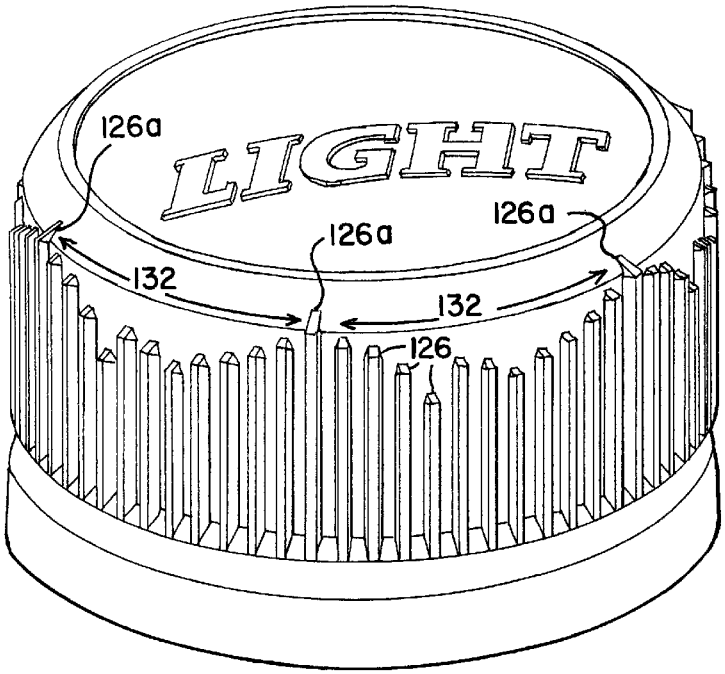
FIG. 3 is a perspective view of a second embodiment closure of the present invention.

FIG. 3 illustrates a further embodiment of the invention, particularly a modified closure 120 that includes a plurality of raised knurls 126 which are regularly spaced around the circumference of the closure 120 but which have axial extents which together form regularly repeated peaked profiles around a circumference of the closure 120. As with the embodiment of FIG. 1, the knurls form gaps 132 which are sized and regularly spaced, to receive application chuck finger elements 61. In this way, the chuck can exert a tangential force on the knurls to rotate the closure.

Figure 4:
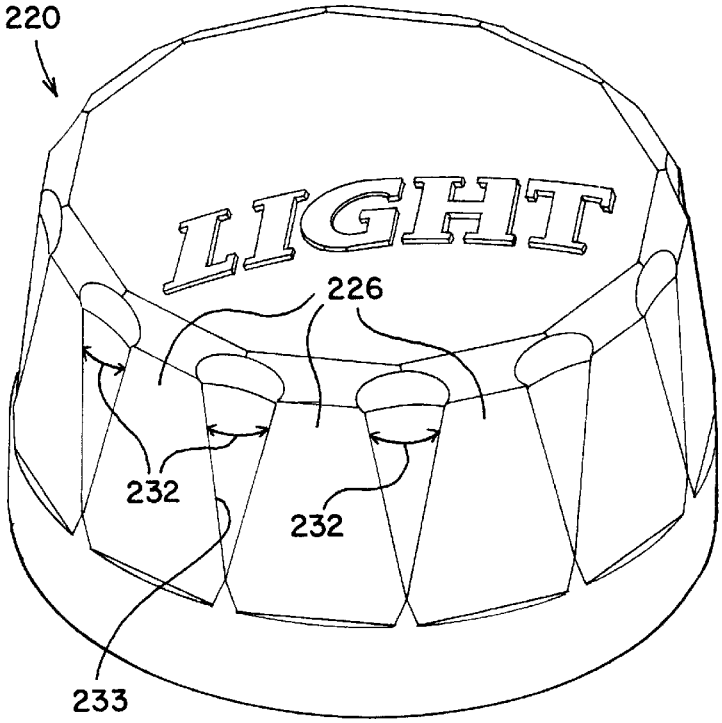
FIG. 4 is a perspective view of a third embodiment closure of the present invention.

FIG. 4 illustrates an alternate closure 220 that includes regularly spaced peaked flat faces 226 spaced around a circumference of the closure. Between the peaked flat faces are substantially shallow conical recesses 233 forming circumferential gaps 232 which can receive the application chuck finger elements 61 as described above with respect to the first two embodiments.

Figure 5:
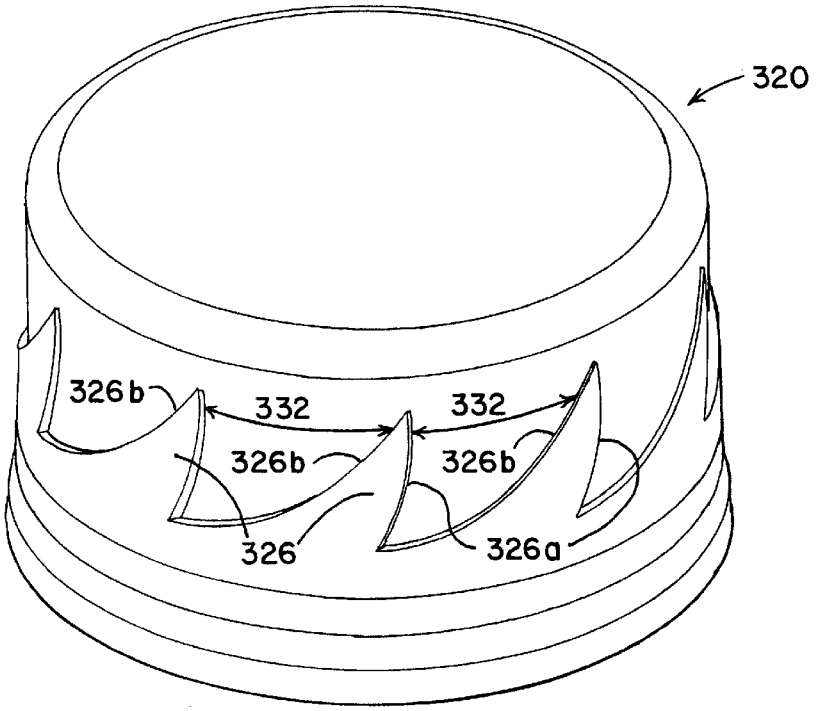
FIG. 5 is a perspective view of a fourth embodiment closure of the present invention.

FIG. 5 illustrates a further alternate closure 320 having raised, wave-like decorative display elements 326 regularly spaced apart by gaps 332 around a circumference of the closure 320. As in the previous embodiment, the wave-like elements can be engaged by the application chuck 60 having finger elements 61 positioned within the gaps 322, to turn the closure 320. The wave-like display elements are connected or "blended" together along a base end region. Each element 326 includes a front surface 326*a* and a back surface 326*b*. Both surfaces 326*a,* 326*b* are angled or curved, and can assist in guiding the application chuck finger elements 61 into the gaps 332. The finger elements 61 can then tangentially press on the front surfaces 326*a* to screw on the closure, or alternately on the back surfaces 326*b* to unscrew the closure.

Figure 6:
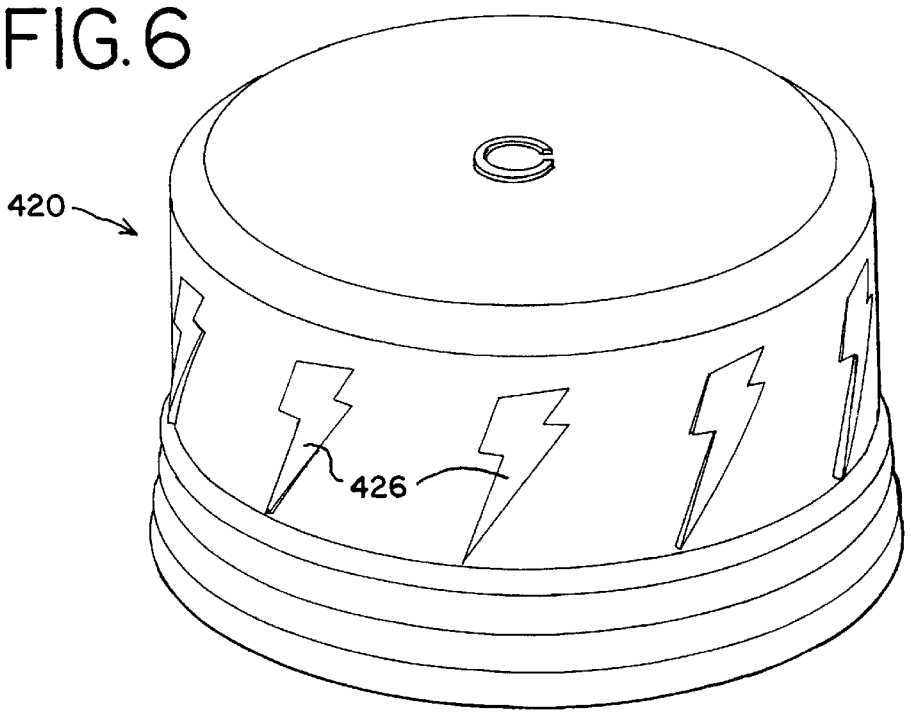
FIG. 6 is a perspective view of a fifth embodiment closure of the present invention.
Figure 7:
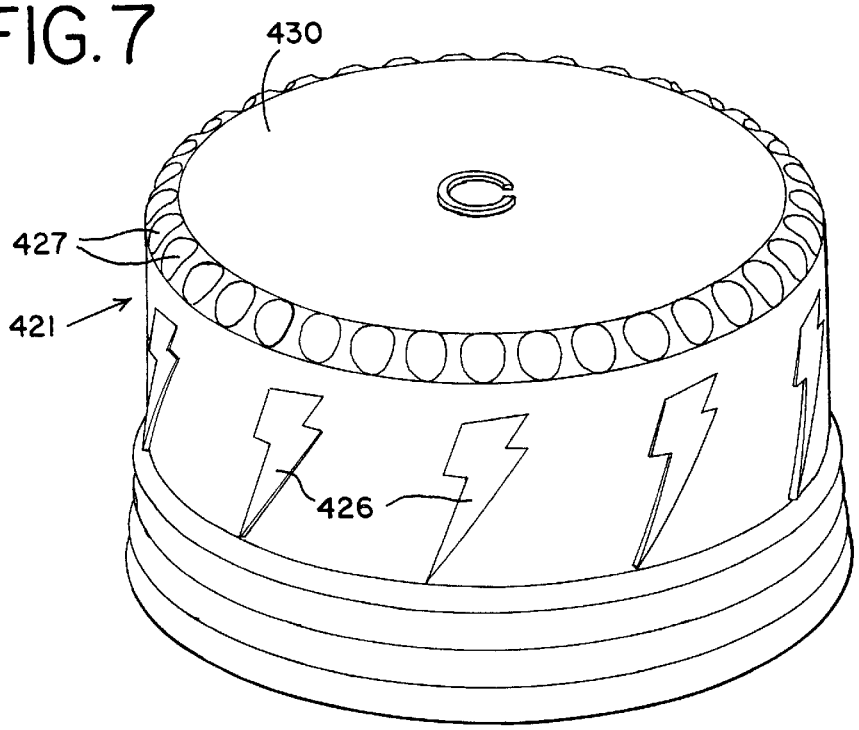
FIG. 7 is a perspective view of a sixth embodiment closure of the present invention.

FIGS. 6 and 7 illustrate two further embodiment closures 420, 421 respectively, of the invention. According to these embodiments, lightning bolt-shaped elements 426 are spaced evenly around a circumference of the closure. The lightning bolt-shaped elements are raised elements which can be engaged by the chuck to turn the closure 420. Gaps 432 between the elements 426 receive the finger elements 61 of the chuck. The closure 421 of FIG. 7 adds dished depressions 427 located around an upper circumference, adjacent to an end wall 430 of the closure. These depressions 427 can be gripped by an application chuck or by a consumer to manipulate the closure 421.

Figure 8:
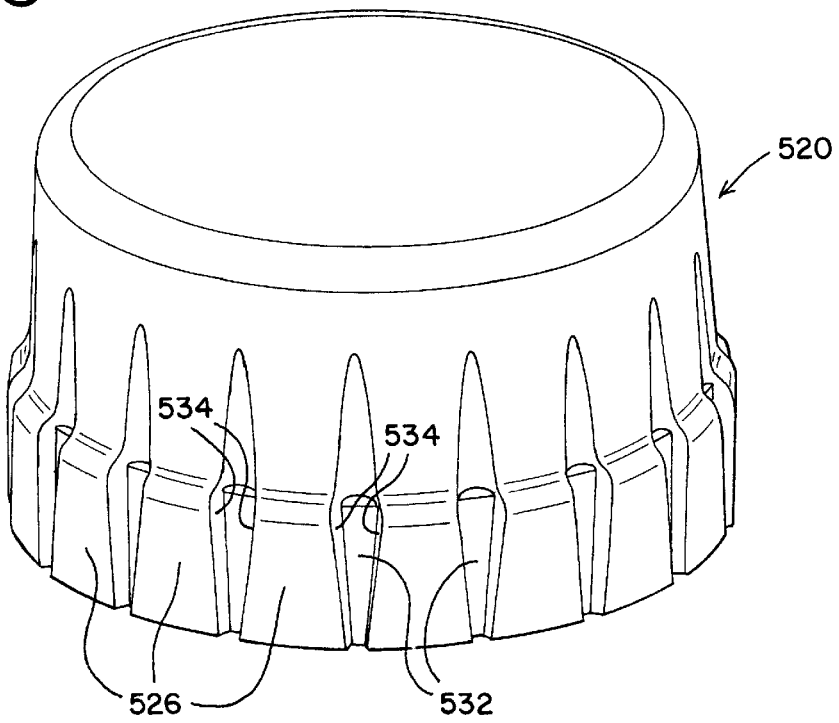
FIG. 8 is a perspective view of a seventh embodiment closure of the present invention.

FIGS. 8 illustrates another embodiment closure 520 of the invention. The closure 520 includes a plurality of spaced apart, raised tapered elements 526 separated by gaps 532. The tapered elements 526 are defined by angled sidewalls 534. As with the previous embodiments, the sidewalls 534 can act to guide finger elements 61 of the chuck 60 into the gaps 532. The finger elements 61 can press on some of the sidewalls 534 tangentially to rotate the closure.

It is a further aspect of the invention that, for the above described various embodiments, the total number of gaps for receiving gripping finger elements of the chuck be less than about 20, and preferably less than about 10. This allows room for a finger element 61 to be positioned within the a gap.

As a still further aspect of the invention that, for the above described various embodiments, the display elements are useful to be engaged, not only by a chuck having independent finger elements, but by an elastomeric cup element of a chuck which would conform around the display elements to be able to exert a tangential force on the display elements to turn the closure.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A closure comprising:

an end wall; and a sidewall depending from said end wall, said sidewall having a raised decorative display, wherein said display comprises a stepped profile having a first region adjacent an open end of said sidewall, and a second region, stepped from said first region on a side of said first region away from said open end.

2. The closure according to claim 1, wherein said raised display has an outside surface with multiple radial extents.

3. The closure according to claim 1, wherein said raised decorative display comprises display elements arranged at regularly spaced intervals around a circumference of said sidewall.

4. The closure according to claim 3, wherein each said display elements include a first region having a first radial extent, and a second region having a second radial extent less than said first radial extent.

5. The closure according to claim 3, wherein said display elements comprise peaked shapes.

6. The closure according to claim 3, wherein display elements are spaced to form gaps between adjacent display elements, said gaps sized and shaped to be engaged by an application chuck.

7. A method of tuning a closure, comprising the steps of:

gripping the closure with a chuck;

providing that the closure has a raised decorative display, said display comprising a stepped profile having a first region adjacent an open end of said closure, and a second region stepped from said first region on a side of said first region away from said open end;

turning said closure with said chuck by exerting tangential force on said decorative display.

8. The method according to claim 7, wherein said step of providing said closure is further defined in that said decorative display comprises regularly spaced display elements having gaps between adjacent display elements, at least one of said gaps being sized to receive a gripping portion of said chuck to turn said closure.

9. A closure for a bottle finish, comprising:

an end wall; and a sidewall depending from said end wall, said sidewall having a substantially smooth surface with raised decorative display elements extending from said substantially smooth surface and forming gaps at regular intervals around a circumference of said sidewall, said gaps having a circumferential width sufficient for receiving a finger element of a chuck for turning said closure, wherein said decorative display elements comprise tapered shapes having angularly disposed sides, and said display elements are joined together at base ends thereof, wherein said display elements have a stepped radial thickness, stepped in decreasing thickness in an axial direction away from said open end.

10. The closure according to claim 9, wherein said closure includes less than 20 gaps.

11. The closure according to claim 10, wherein said closure includes less than 10 gaps.

12. A closure comprising:

an end wall; and a sidewall depending from said end wall, said sidewall having a raised decorative display, wherein said raised display has an outside surface with multiple radial extents, and said radial extents are stepped, decreasing in an axial direction away from an open end of said sidewall.

13. A closure for a bottle finish, comprising:

an end wall;

a sidewall depending from said end wall, said sidewall having a substantially smooth surface with raised decorative display elements extending from said substantially smooth surface and forming gaps at regular intervals around a circumference of said sidewall, said gaps have a circumferential width sufficient for receiving a finger element of a check for turning said closure, wherein said display elements have a stepped radial thickness stepped in decreasing thickness in an axial direction away from said open end.

14. The closure according to claim 13, wherein said decorative display elements comprise tapered shaped having angularly disposed sides.

15. The closure according to claim 13, wherein said display elements are joined together at base ends thereof.

* * * * *